US005938256A

United States Patent [19]

Lovette

[11] Patent Number: 5,938,256

[45] Date of Patent: Aug. 17, 1999

[54] BOTTLE CARRIER APPARATUS

[76] Inventor: James K. Lovette, 1876 Mission Hill Rd. NE., Wesson, Miss. 39191

[21] Appl. No.: 09/086,859

[22] Filed: May 29, 1998

[51] Int. Cl.[6] ..... B65D 23/10; B65D 71/00

[52] U.S. Cl. ..... 294/87.2; 294/31.2; 294/159; 294/170; 206/150

[58] Field of Search ..... 294/87.2, 137, 294/150, 153, 154, 159, 162, 165, 170, 31.2; 206/150, 151; 215/396

[56] References Cited

U.S. PATENT DOCUMENTS

| | | | |
|---|---|---|---|
| 360,769 | 4/1887 | Frost | 294/154 |
| 750,782 | 1/1904 | Ramsey | 294/154 |
| 1,498,247 | 6/1924 | Stewart | 294/170 |
| 2,611,639 | 9/1952 | Sadeck . | |
| 2,809,861 | 10/1957 | Socke . | |
| 3,188,130 | 6/1965 | Pietrowicz | 294/137 |
| 3,709,545 | 1/1973 | Oltmanns | 294/87.2 |
| 4,325,503 | 4/1982 | Swinney . | |
| 4,488,748 | 12/1984 | Burkes | 294/154 |
| 4,678,221 | 7/1987 | Josenhans . | |
| 4,867,359 | 9/1989 | Donovan | 294/150 |
| 5,645,307 | 7/1997 | Wengler | 294/165 |
| 5,695,232 | 12/1997 | Tipp . | |

FOREIGN PATENT DOCUMENTS

| | | | |
|---|---|---|---|
| 77893 | 1/1951 | Norway | 294/87.2 |

*Primary Examiner*—Dean Kramer

[57] ABSTRACT

A bottle carrier apparatus includes a first adjustable flexible loop assembly which includes a first loop portion and a first rider member connected to a translatable end of the first loop portion. A handle portion is connected at a first handle end to the first loop portion. A second adjustable flexible loop assembly includes a second loop portion connected to a second handle end of the handle portion. A second rider member is connected to a translatable end of the second loop portion. The first loop portion and the second loop portion have a loop width. The handle portion has a handle width, and the handle width is greater than the loop width. The first loop portion and the second loop portion have a rectangular cross-section, and the first rider member and the second rider member have a rectangular loop reception channel. The handle portion includes a top surface which includes advertising indicia. The first loop portion and the second loop portion have a circular cross-section, and the first rider member and the second rider member have a circular loop reception channel. To use the apparatus, the respective adjustable flexible loop assemblies are loosened, the loosened loop assemblies are placed over necks of bottles, and the loop assemblies are tightened. Then the bottles can be carried by lifting the handle portion.

7 Claims, 3 Drawing Sheets

FIG 3
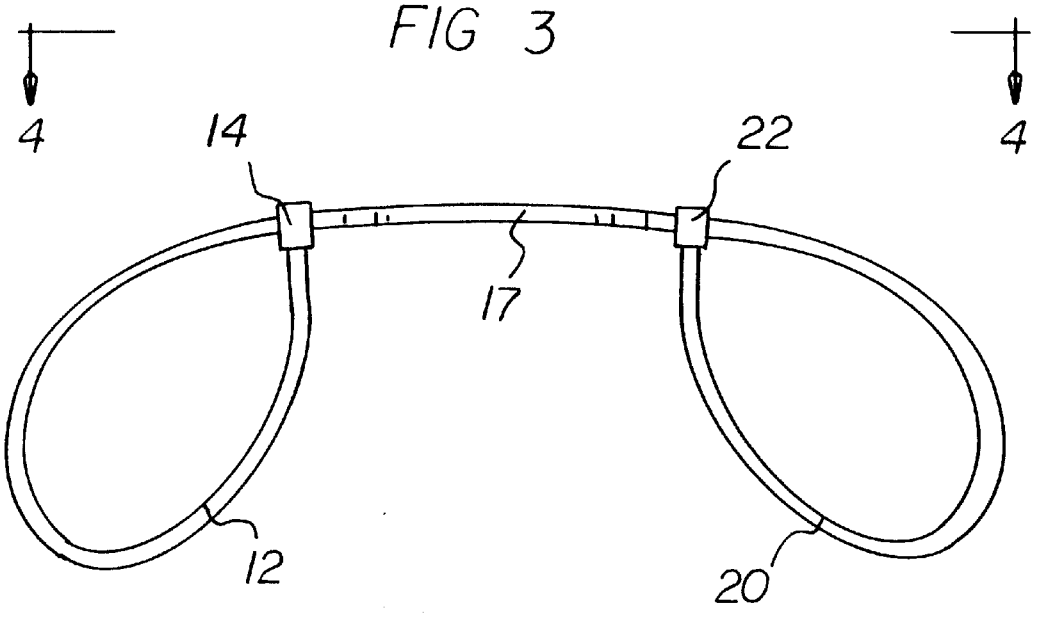
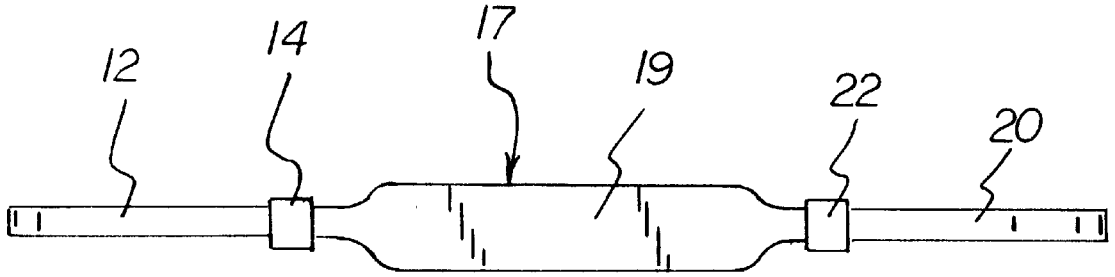
FIG 4

FIG 5
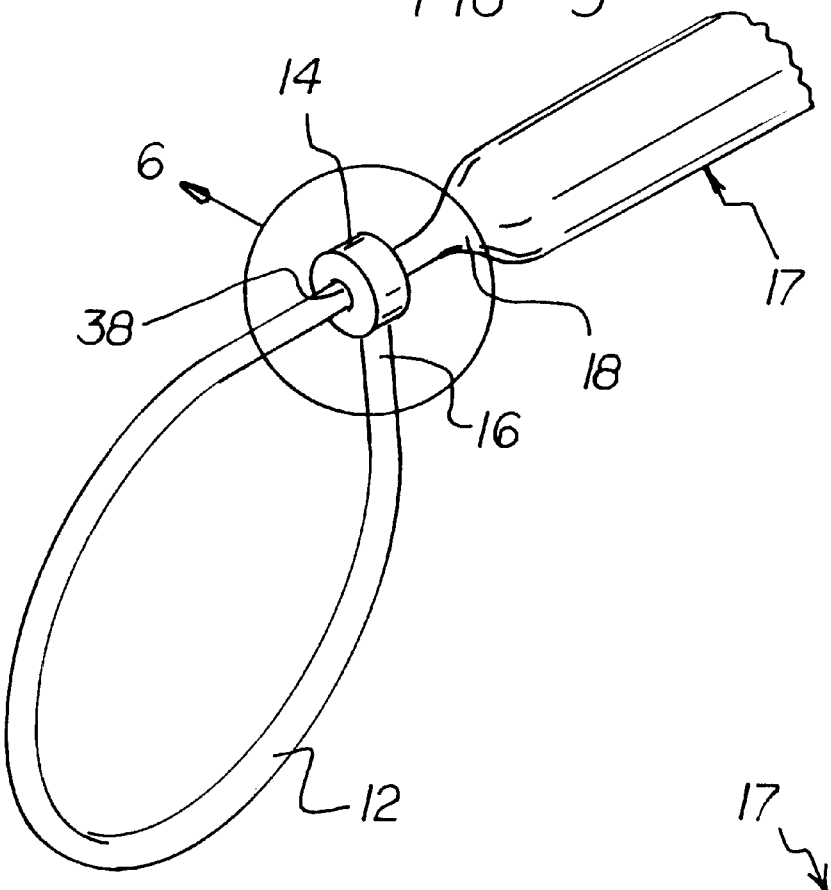
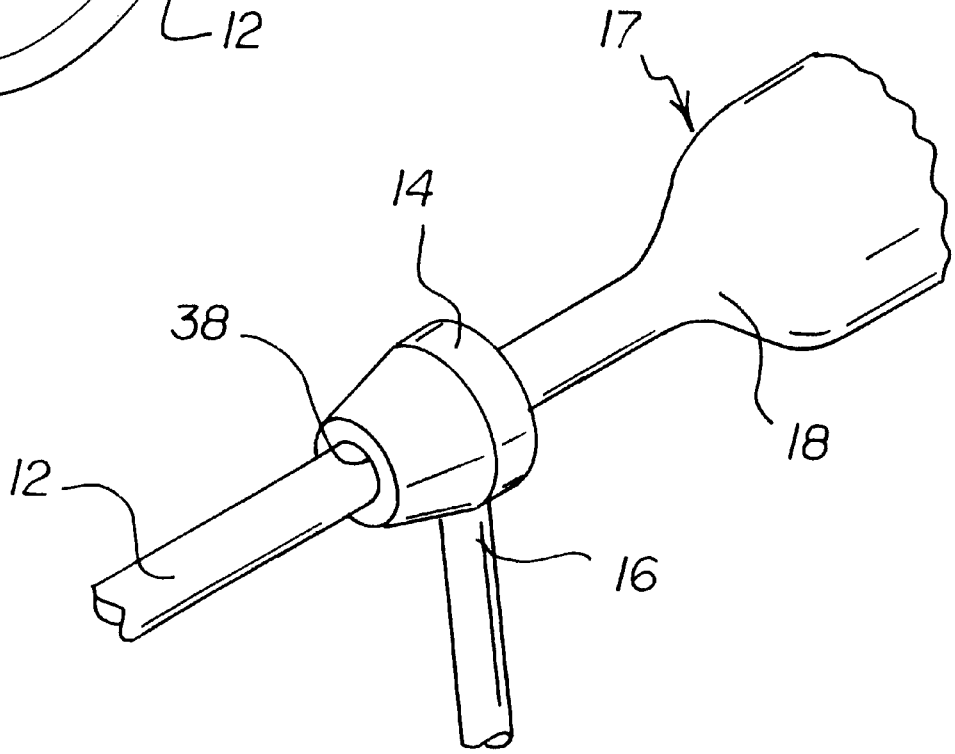
FIG 6

BOTTLE CARRIER APPARATUS

BACKGROUND OF THE INVENTION

1. Field of the Invention

The present invention relates generally to carriers and, more particularly, to carriers especially adapted for carrying two bottles at a time.

2. Description of the Prior Art

Because of the bulky shape of bottles, handles are often attached to bottles to facilitate carrying them. Moreover, it is often desirable to carry two bottles at a time in one hand. In this respect, throughout the years, a number of innovations have been developed relating to handles for carrying two bottles at a time, and the following U.S. patents are representative of some of those innovations: U.S. Pat. Nos. 2,611,639, 2,809,861, 4,678,221, and 5,695,232. More specifically, each of U.S. Pat. Nos. 2,611,639 and 2,809,861 discloses a respective device for carrying two milk bottles or cartons. Each of these devices includes two stiff loops which have predetermined internal diameters. Because the neck portions of different bottles have different sizes, it would be desirable if a bottle carrier were provided which had flexible loops for adapting to a variety of bottle neck sizes.

U.S. Pat. No. 4,678,221 discloses a bottle carrier for two bottles which includes a single flexible loop a portion of which is threaded through a rigid hollow handle. With this device, no provision is made for locking the loop onto each bottle to secure each bottle to the loop. To prevent a bottle from dropping away from a bottle carrying loop, it would be desirable if a bottle carrier were provided which includes a locking device for locking each bottle to a carrying loop.

U.S. Pat. No. 5,695,232 a carrier for a pair of bottles wherein the carrier includes apertures for receiving the tops of two bottles and which includes two handle portions which are placed in registration which each other when a person's hand is used for carrying the bottles. To simplify the carrying of two bottles, it would be desirable if a bottle carrier were provided which does not require two handle portions to be placed in registration for two bottles to be carried.

In addition, U.S. Pat. No. 2,809,861 may be of interest for its disclosure of a can holder that includes a rigid frame and flexible straps.

Still other features would be desirable in a bottle carrier device. For example, it would be desirable if advertising matter could be printed on the handle portion of the bottle carrier device. Although plastic loops for carrying bottles can be made of relatively thin plastic, a handle portion of a bottle carrier apparatus should preferably be wider than the loops for greater comfort for the person grasping the handle portion.

In grocery stores, when bottles are placed in plastic bags, the bottles often tear the plastic bags. To prevent such an occurrence, it would be desirable if a bottle carrier were provided which enables two bottles to be carried without using a plastic bag.

Thus, while the foregoing body of prior art indicates it to be well known to use a bottle carrier for carrying two bottles at a time, the prior art described above does not teach or suggest a bottle carrier apparatus which has the following combination of desirable features: (1) has flexible loops for adapting to a variety of bottle neck sizes; (2) includes a friction-dependent locking device for locking each bottle to a carrying loop; (3) does not require two handle portions to be placed in registration for two bottles to be carried; (4) has a handle between two flexible carrying loops which is as flexible, or is more or less flexible, than the two carrying loops; (5) has advertising matter printed on the handle portion; (6) enables two bottles to be carried without using a plastic bag; and (7) has a handle portion which is wider than the carrying loops for greater comfort for the person grasping the handle portion. The foregoing desired characteristics are provided by the unique bottle carrier apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a bottle carrier apparatus which includes a first adjustable flexible loop assembly which includes a first loop portion and a first rider member connected to a translatable end of the first loop portion. A handle portion is connected at a first handle end to the first loop portion. A second adjustable flexible loop assembly includes a second loop portion connected to a second handle end of the handle portion. A second rider member is connected to a translatable end of the second loop portion.

The first loop portion and the second loop portion have a loop width. The handle portion has a handle width, and the handle width is greater than the loop width. The first loop portion and the second loop portion have a rectangular cross-section, and the first rider member and the second rider member have a rectangular loop reception channel. The handle portion includes a top surface which includes advertising indicia.

The first loop portion and the second loop portion have a circular cross-section, and the first rider member and the second rider member have a circular loop reception channel.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle carrier apparatus which has all of the advantages of the prior art and none of the disadvantages.

It is another object of the present invention to provide a new and improved bottle carrier apparatus which may be easily and efficiently manufactured and marketed.

It is a further object of the present invention to provide a new and improved bottle carrier apparatus which is of durable and reliable construction.

An even further object of the present invention is to provide a new and improved bottle carrier apparatus which is susceptible of a low cost of manufacture with regard to both materials and labor, and which accordingly is then susceptible of low prices of sale to the consuming public, thereby making such bottle carrier apparatus available to the buying public.

Still yet a further object of the present invention is to provide a new and improved bottle carrier apparatus which has flexible loops for adapting to a variety of bottle neck sizes.

Still another object of the present invention is to provide a new and improved bottle carrier apparatus that includes a friction-dependent locking device for locking each bottle to a carrying loop.

Yet another object of the present invention is to provide a new and improved bottle carrier apparatus which does not require two handle portions to be placed in registration for two bottles to be carried.

Even another object of the present invention is to provide a new and improved bottle carrier apparatus that has a handle between two flexible carrying loops which is as flexible, or is more or less flexible, than the two carrying loops.

An even further object of the present invention is to provide a new and improved bottle carrier apparatus which has advertising matter printed on the handle portion.

Yet another object of the present invention is to provide a new and improved bottle carrier apparatus that enables two bottles to be carried without using a plastic bag.

Still another object of the present invention is to provide a new and improved bottle carrier apparatus which has a handle portion which is wider than the carrying loops for greater comfort for the person grasping the handle portion.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a side view of the embodiment of the bottle carrier apparatus of FIG. 2.

FIG. 4 is a top view of the embodiment of the bottle carrier apparatus of FIG. 3 taken along line 4—4 thereof.

FIG. 5 is a perspective view of a second embodiment of the loop portion of the invention.

FIG. 6 is an enlarged perspective view of the portion of the embodiment of the invention shown in FIG. 5 contained in encircled region 6 thereof.

DESCRIPTION OF THE PREFERRED EMBODIMENT

Figure 1:
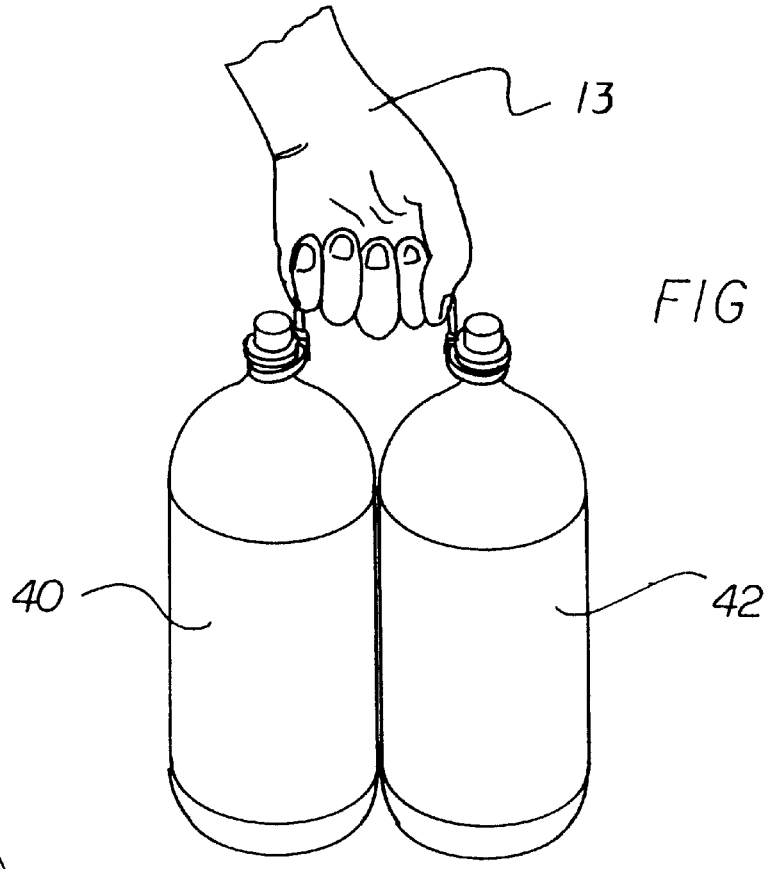
FIG. 1 is a perspective view showing a preferred embodiment of the bottle carrier apparatus of the invention in use with two bottles being carried by a person's hand.
Figure 2:
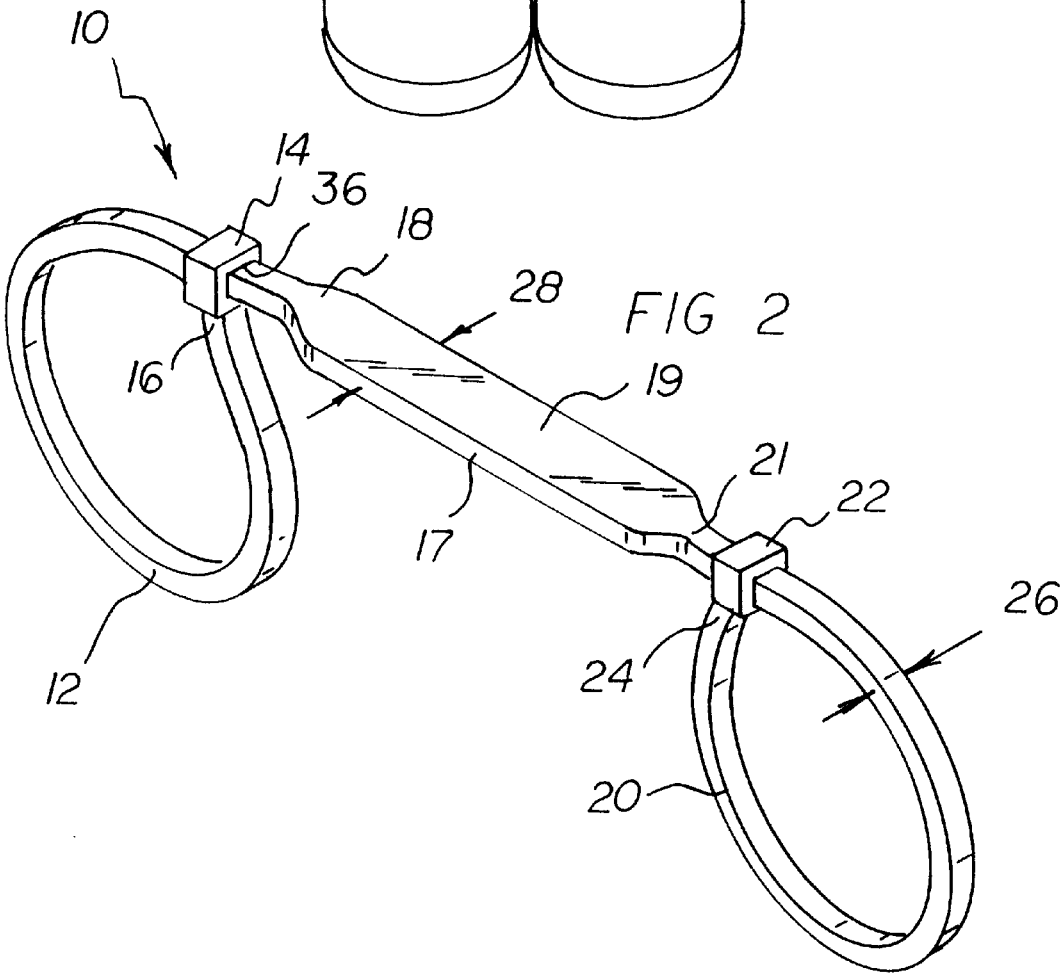
FIG. 2 is a perspective view of the embodiment of the bottle carrier apparatus shown in FIG. 1 removed from the two bottles and released from the person's hand.

With reference to the drawings, a new and improved bottle carrier apparatus embodying the principles and concepts of the present invention will be described.

Turning to FIG. 14, there is shown a first embodiment of the bottle carrier apparatus of the invention generally designated by reference numeral 10. In its preferred form, bottle carrier apparatus 10 includes a first adjustable flexible loop assembly which includes a first loop portion 12 and a first rider member 14 connected to a translatable end 16 of the first loop portion 12. A handle portion 17 is connected at a first handle end 18 to the first loop portion 12. A second adjustable flexible loop assembly includes a second loop portion 20 connected to a second handle end 21 of the handle portion 17. A second rider member 22 is connected to a translatable end 24 of the second loop portion 20. The handle portion 17 may be substantially rigid or substantially flexible, i.e. the handle may be more rigid than either the first loop portion or the second loop portion, may be less rigid than either the first loop portion or the second loop portion, or may be as rigid or as flexible as the first loop portion or the second loop portion.

The first loop portion 12 and the second loop portion 20 have a loop width 26. The handle portion 17 has a handle width 28, and the handle width 28 is greater than the loop width 26. As shown in FIGS. 14, the first loop portion 12 and the second loop portion 20 have a rectangular cross-section, and the first rider member 14 and the second rider member 22 have a rectangular loop reception channel 36. The handle portion 17 includes a top surface 19 which includes advertising indicia.

As shown in FIGS. 5 and 6, the first loop portion 12 and the second loop portion 20 have a circular cross-section, and the first rider member 14 and the second rider member 22 have a circular loop reception channel 38.

To use the bottle carrier apparatus 10 of the invention, for a first bottle 40 to be carried, the first rider member 14 is slid along the first loop portion 12 so that the internal diameter of the first adjustable flexible loop assembly is larger than the outer diameter of the neck of the first bottle 40. The enlarged first adjustable flexible loop assembly is placed over the neck of the first bottle 40, and the first rider member 14 is slid along the first loop portion 12 so that the inner diameter of the first adjustable flexible loop assembly is made smaller than the neck diameter of the first bottle 40. A similar procedure is carried out for the second adjustable flexible loop assembly and the second bottle 42. When the handle portion 17 is grasped by the hand 13 of a user and lifted, the two bottles are lifted up and can be carried the user, as shown in FIG. 1.

To release the bottles, the first rider member 14 and the second rider member 22 are loosened on the first loop portion 12 and the second loop portion 20, respectively, so that the respective internal diameters of the first adjustable flexible loop assembly and the second adjustable flexible loop assembly are larger than the respective outer diameters of the necks of the bottles. Then, the adjustable flexible loop assemblies can be lifted off of the bottles.

The components of the bottle carrier apparatus of the invention can be made from inexpensive and durable plastic materials, preferably of a recyclable nature.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bottle carrier apparatus that is low in cost, relatively simple in design and operation, and which may advantageously be used for adapting to a variety of bottle neck sizes. With the invention, a bottle carrier apparatus is provided which includes a friction-dependent locking device for locking each bottle to a carrying loop. With the invention, a bottle carrier apparatus is provided which does not require two handle portions to be placed in registration for two bottles to be carried. With the invention, a bottle carrier apparatus is provided which has a handle between two flexible carrying loops which is as flexible, or is more or less flexible, than the two carrying loops. With the invention, a bottle carrier apparatus is provided which has advertising matter printed on the handle portion. With the invention, a bottle carrier apparatus is provided which enables two bottles to be carried without using a plastic bag. With the invention, a bottle carrier apparatus is provided which has a handle portion which is wider than the carrying loops for greater comfort for the person grasping the handle portion.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A bottle carrier apparatus, comprising:

a first adjustable flexible loop assembly which includes a first loop portion and a first rider member connected to a translatable end of said first loop portion, a handle portion connected at a first handle end to said first loop portion, a second adjustable flexible loop assembly which includes a second loop portion connected to a second handle end of said handle portion and which includes a second rider member connected to a translatable end of said second loop portion;

wherein said first loop portion and said second loop portion have a transverse loop width, said handle portion has a transverse handle width, and said transverse handle width is greater than said transverse loop width to define abutment shoulders for each said first and second rider member, said abutment shoulders being located at said first and second handle ends, respectively;

wherein said first loop portion and said second loop portion have a loop thickness measured orthogonal to said transverse loop width, said handle portion has a handle thickness measured orthogonal to said transverse handle width, and said first and second loop thickness is substantially the same as said handle thickness such that said abutment shoulders extend laterally with respect to proximal portions of said first and second loop portions, and wherein said first loop portion, said second loop portion and said handle portion being a unitary structure of the same material, whereby said handle portion being of greater transverse width than said first and second loop portions provide the multiple functions of defining said abutment shoulders for each said first and second rider member, facilitating gripping of the handle portion in the palm of an individuals's hand, and providing a surface for advertising indicia.

2. The apparatus of claim 1 wherein said handle portion is substantially rigid.

3. The apparatus of claim 1 wherein said handle portion is as flexible as either said first loop portion or second loop portion.

4. The apparatus of claim 1 wherein said handle portion is less flexible as either said first loop portion or second loop portion.

5. The apparatus of claim 1 wherein said handle portion is more flexible as either said first loop portion or second loop portion.

6. The apparatus of claim 1 wherein said handle portion includes a top surface which includes advertising indicia.

7. The apparatus of claim 1 wherein:

said first loop portion and said second loop portion have a rectangular cross-section, and said first rider member and said second rider member have a rectangular loop reception channel.

* * * * *